United States Patent [19]

Röck

[11] Patent Number: 4,955,160

[45] Date of Patent: Sep. 11, 1990

[54] GUIDE WALL ASSEMBLY FOR DRAWERS

[75] Inventor: Erich Röck, Höchst, Austria

[73] Assignee: Julius Blum Gesellschaft m.b.H., Höchst, Austria

[21] Appl. No.: 392,285

[22] Filed: Aug. 11, 1989

[30] Foreign Application Priority Data

Sep. 15, 1988 [AT] Austria ..... 2265/88

[51] Int. Cl.[5] ..... E04F 11/24

[52] U.S. Cl. ..... 312/340; 312/341.1; 384/19

[58] Field of Search ..... 312/339, 334, 340, 341.1, 312/349; 384/18, 19

[56] References Cited

U.S. PATENT DOCUMENTS

| | | | |
|---|---|---|---|
| 2,675,277 | 4/1954 | McClellan | 312/349 |
| 2,864,656 | 12/1958 | Yorinks | 312/339 |
| 3,912,341 | 10/1975 | Stein | 312/341.1 |
| 4,305,625 | 12/1981 | Gutner | 312/341.1 |
| 4,659,237 | 4/1987 | Rapp | 384/19 |

FOREIGN PATENT DOCUMENTS

| | | | |
|---|---|---|---|
| 0609836 | 6/1926 | France | 384/18 |

*Primary Examiner*—Kenneth J. Dorner
*Assistant Examiner*—Gerald Anderson
*Attorney, Agent, or Firm*—Wenderoth, Lind & Ponack

[57] ABSTRACT

A guide rail assembly for a drawer includes, for each side of the drawer, a supporting rail on the side of an article or body of furniture and a pull-out rail slideably mounted on the supporting rail. The load of the drawer is transmitted by means of cylindrical runner rollers and/or balls. The runner rollers or balls are arranged substantially in a horizontal plate and adjacently mounted in carriages. The supporting rail has a guide flange with a U-shaped channel and outwardly projecting horizontal marginal flanges extending from both sides thereof. Central runner rollers roll in the U-shaped channel, and lateral runner rollers roll on the marginal flanges. The pull-out rail embraces the supporting rail. The pull-out rail has on each side thereof an outwardly projecting horizontal running flange which is spaced from the upper and lower edges of the pull-out rail. Balls, runner rollers and/or slides roll on the running flanges of the pull-out rail and carry on each side of the drawer a drawer rail which is fastened thereto.

11 Claims, 8 Drawing Sheets

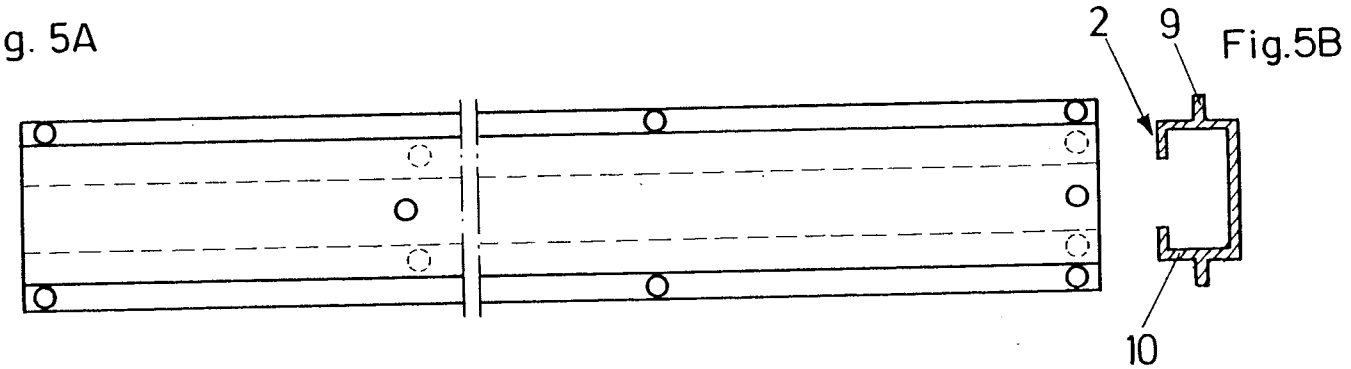
Fig.5B
Fig. 5A
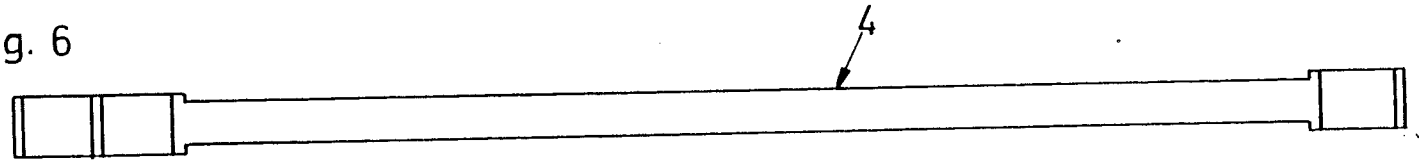
Fig. 6
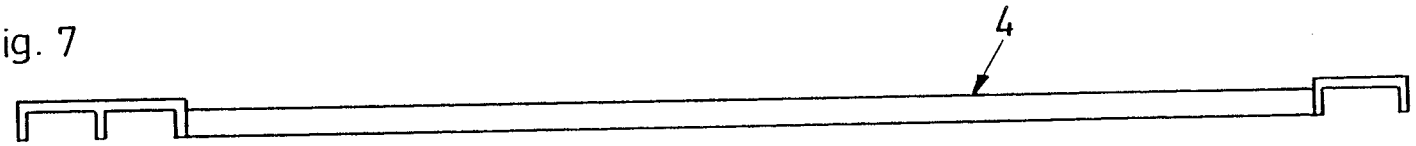
Fig. 7

GUIDE WALL ASSEMBLY FOR DRAWERS

FIELD AND BACKGROUND OF THE INVENTION

The invention relates to a guide rail assembly for drawers and including, for each side of the drawer, a supporting rail to be attached to the side of a body or article of furniture and a pull-out rail slideably mounted on the supporting rail. The load of the drawer is transmitted between the pull-out rail and the supporting rail by means of runner rollers and/or balls which are substantially in a horizontal plane and adjacently mounted in carriages. The supporting rail has a U-shaped channel with outwardly projecting horizontal marginal flanges on both sides thereof. Runner rollers or balls run in the U-shaped channel on one side of the supporting rail and run on the marginal flanges on the other side of the supporting rail. The pull-out rail is C-shaped and embraces the carriage.

Guide rail assemblies of the afore-mentioned kind are widely used in modern furniture construction, in particular in the construction of kitchen and office furniture. Such assemblies are designed to facilitate extraction and insertion of a drawer or shelf, to make these motions as smooth as possible and to prevent the drawer or shelf from tilting when it is partly extracted from or inserted into the body of the piece or article of furniture.

Guide rail assemblies should, apart from the aforementioned functions, fulfill further requirements. They should not, or should only slightly, reduce the loading capacity of the drawer, i.e. as little space as possible should be occupied by the guide rail assemblies with respect to the width or breadth of the drawer. Furthermore, it is advantageous for the carriage to be covered by the drawer to the greatest possible extent and thereby be protected against excessive ingress of dust. Thereby, not only appearance advantages but also a lengthened operational life of the guide rail assembly are obtained.

It is known to manufacture the side walls of the drawer from plastics material, for example by extrusion. It is further known to arrange the pull-out rails of the guide rail assembly in the drawer side walls, and it is also known to cover the pull-out rails and the carriages outwardly by means of a downwardly extending cover elements.

One example of a guide rail assembly in which the rails are arranged underneath the drawer bottom is described in AT-PS No. 362 899. A guide rail assembly of this kind has the advantage that it can be integrated into the piece of furniture in a very space-saving manner so that it requires no substantial space in the direction of the breadth of the drawer.

A pull-out guide assembly is known from DE-OS No. 35 40 787 which guarantees smooth running and good lateral guiding for heavy drawers. The rails of this assembly are fastenable to the piece of furniture in a very space-saving manner. In guide rail assemblies of this kind smooth running of a ball bearing guidance is combined with simple construction of a carriage guidance with cylindrical runner rollers.

SUMMARY OF THE INVENTION

It is the object of the invention to provide an improved pull-out guide assembly of the afore-mentioned kind in such a manner that a differential pull-out guide can be obtained, i.e. that the drawer can be fully pulled out from the body of the piece of furniture and at the same time remain anchored in the piece of furniture.

According to the invention this is achieved in that the pull-out rail has on each side thereof a horizontal running flange which extends outwardly from a vertical flange and is spaced from the upper and lower edges of the pull-out rail. Balls, runner rollers and/or slides, on both sides of the pull-out rail, carry a drawer rail and run on such running flanges. Advantageously, the drawer rail has a U-shaped or C-shaped profile. Thus, forces are applied symmetrically and tilting is prevented.

An embodiment of the invention provides that the running flanges of the pull-out rail are provided with stops which limit the withdrawal movement or extracting path. By means of this arrangement plural carriages can be provided on each side of the drawer when the drawer is fully extracted or pushed in.

A further embodiment provides that the slides are fastened to the drawer rail, and that the runner rollers and/or balls which are arranged between the drawer rail and the pull-out rail are mounted in carriages. This arrangement of the slides allows a low structural height. In this arrangement, it is advantageously provided that the slides are L-shaped and have guide faces for the running flanges of the pull-out rail.

Advantageously it is further provided that the running flanges are arranged substantially at half the height of the vertical flanges of the pull-out rail.

BRIEF DESCRIPTION OF THE DRAWINGS

In the following embodiments of the invention will be described with reference to the accompanying drawings in which:

FIGS. 5A and 5B are a side view and a cross-sectional view, respectively, of a pull-out rail of a further embodiment;

FIG. 6 is a side view of a central carriage;

FIG. 7 is a top view of such central carriage;

DESCRIPTION OF THE PREFERRED EMBODIMENTS

Figure 1:
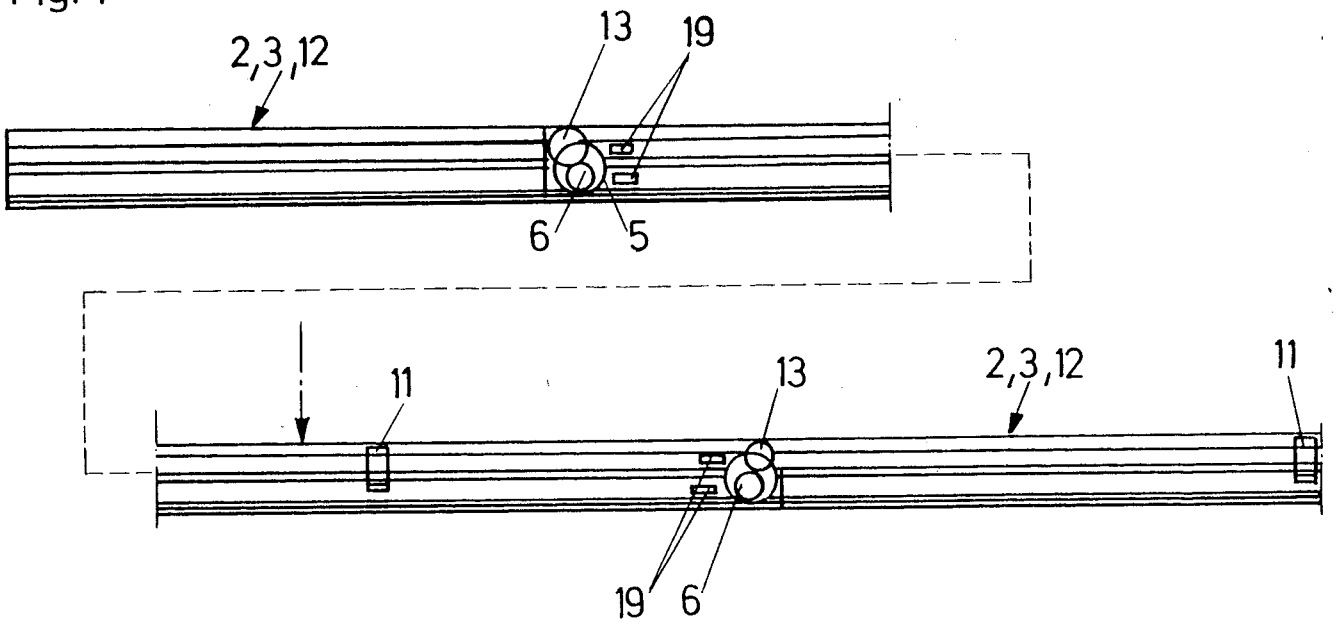
FIG. 1 is a diagrammatic side view of a guide rail assembly according to the invention, to be used on one side of a drawer, and shown in a position wherein the drawer would be pushed into the body of an article of furniture.
Figure 2:
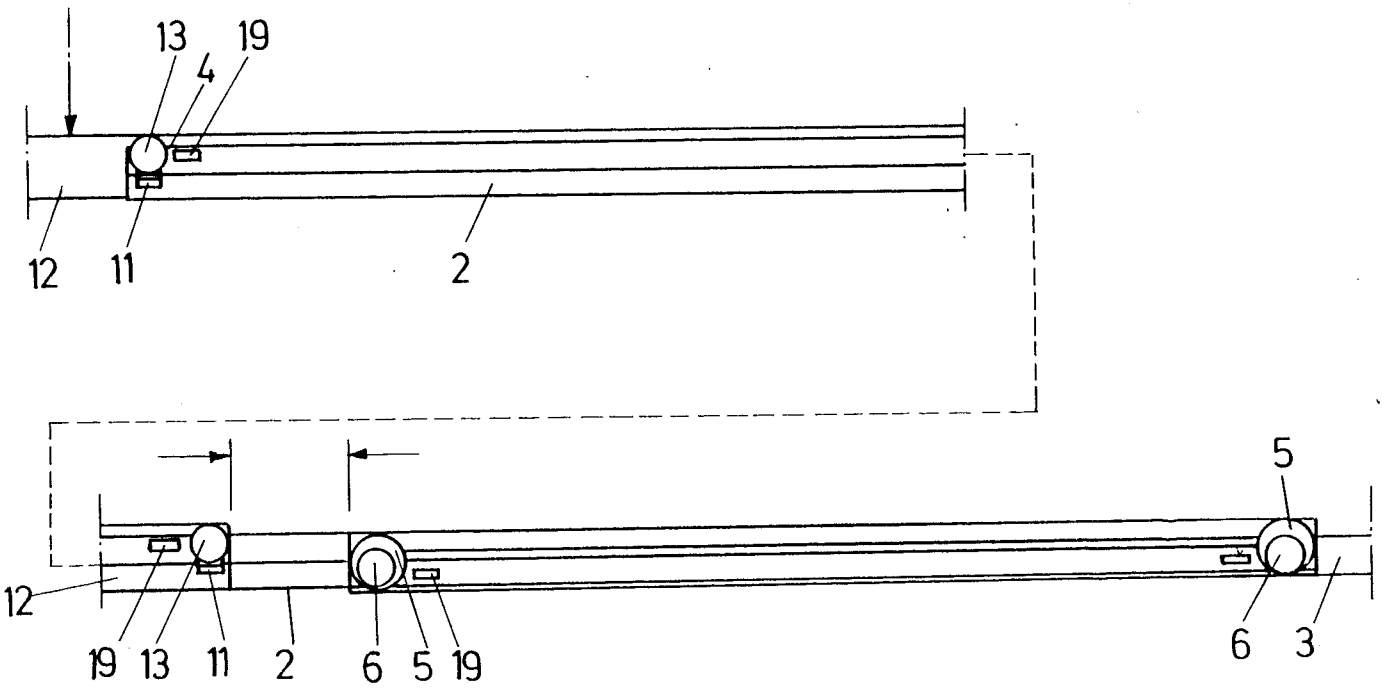
FIG. 2 is a similar side view of the guide rail assembly, the parts being shown drawn apart.

The drawings show only one side wall 18 and a bottom 17 of a drawer 1. The guide rail assembly according to the invention comprises on each side of the drawer 1 a drawer rail 12, a supporting rail 3 on the side of the body or article of furniture and a central pull-out rail 2. The pull-out rail 2 runs differentially between the supporting rail 3 and the drawer rail 12. A central carriage 4 is arranged between the supporting rail 3 and the pull-out rail 2. The rails 2, 3, 12 are arranged underneath the drawer bottom 17 or beside the drawer bottom next to a side wall 18 of the drawer 1. The carriage 4 is arranged such that runner rollers 5 thereof are not superjacent but rather are behind one another in one plane.

The supporting rail 3 has a guide flange with a U-shaped cross-section and two outwardly projecting horizontal marginal flanges 7. The runner rollers 5 of the carriage 4 run in a channel which is formed by the U-shaped guide flange. Runner rollers 6 are positioned on opposite sides of each runner roller 5 and run underneath each of the horizontal flanges 7 and on respective horizontal flanges 8 of the pull-out rail 2. The runner rollers 5 have a greater diameter than the runner rollers 6.

As can particularly be seen from FIGS. 3–5B, the pull-out rail 2 is provided with laterial horizontal running flanges 9 which project outwardly from lateral vertical flanges 10 of the pull-out rail 2. The horizontal flanges 9 can, as shown in the embodiments according to FIGS. 3 and 4, be bent from a profile of rail 2 or, as shown in FIGS. 5A–5B, be extruded together with the pull-out rail 2, for example of aluminum.

Figure 3:
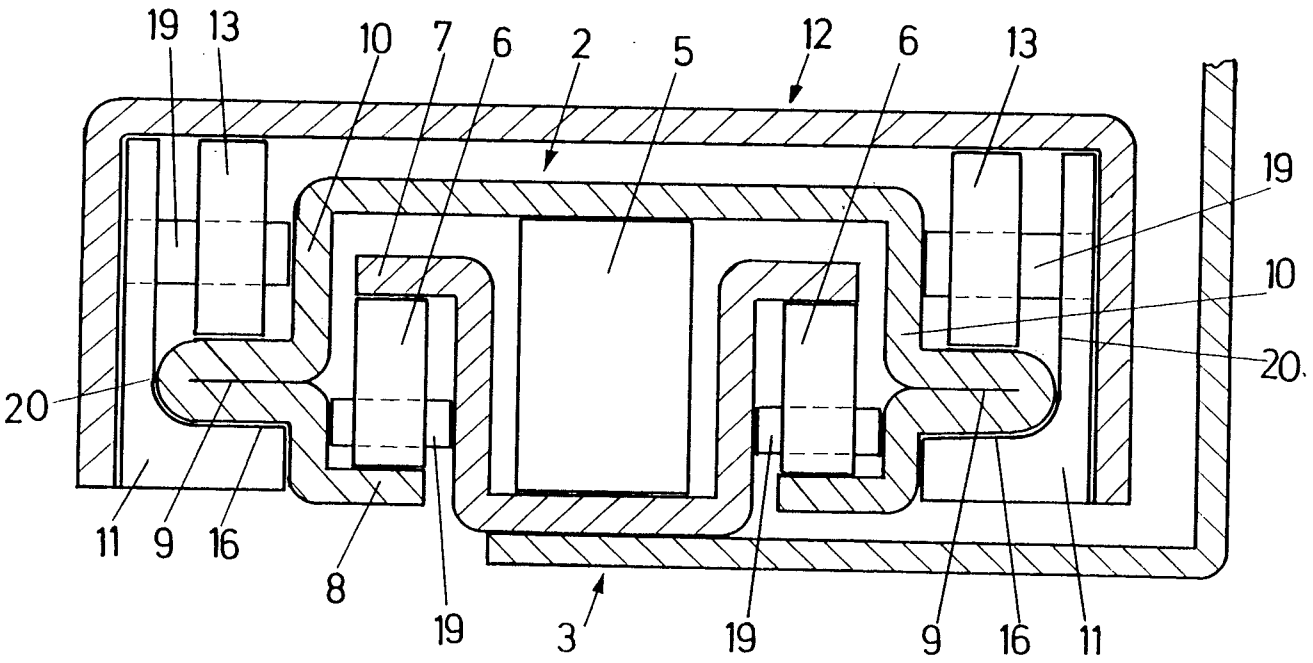
FIGS. 3 and 4 are cross-sectional views of different embodiments of the guide rail assembly.
Figure 4:
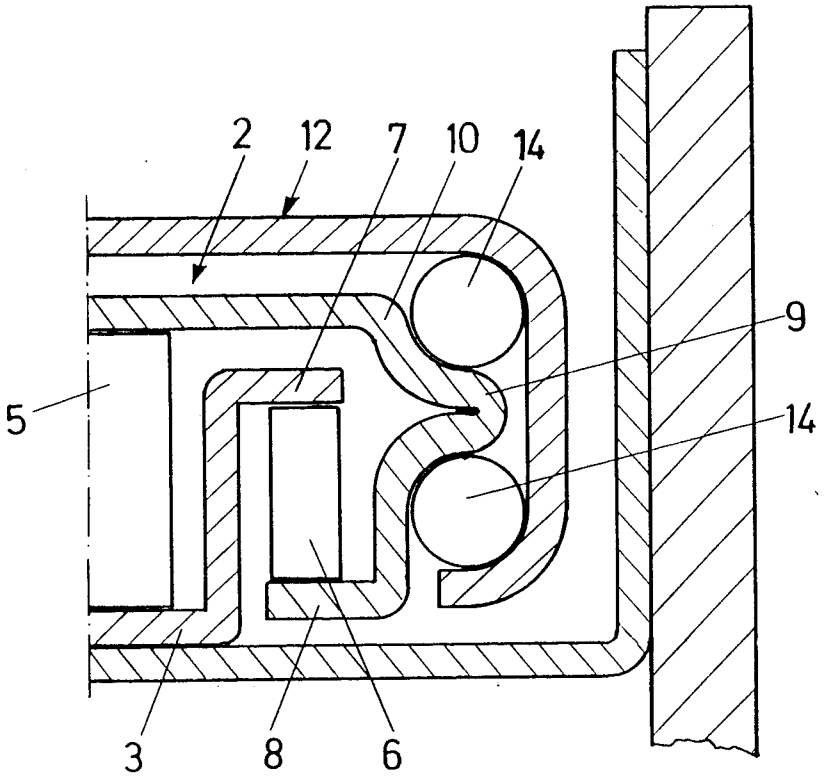
Figure 8:
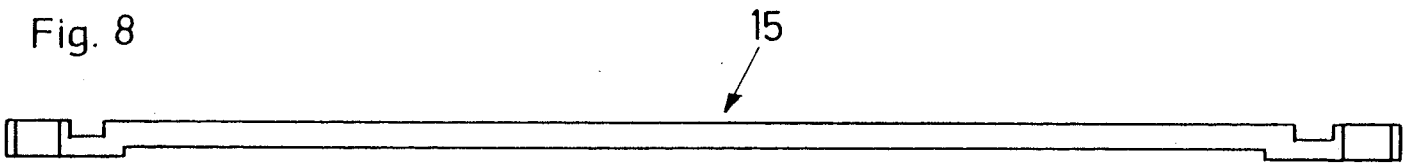
FIGS. 8 and 9 respectively are side and top views of a laterial carriage.
Figure 9:
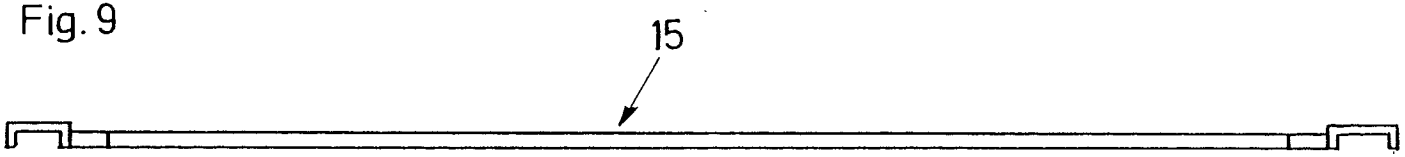

In the embodiment of FIG. 3, the running flanges 9 are guided between slides 11 and runner rollers 13. The drawer rail 12 runs on runner rollers 13, and the slides 11 are fastened to the drawer rail 12. In the embodiment according to FIG. 3, the drawer rail 12 has a U-shaped profile.

Instead of the runner rollers 13 and the slides 11, balls 14 may be arranged between the drawer rail 12 and the pull-out rail 2 and held in cages in a manner known per se. In this case, the drawer rail 12 has a C-shaped profile, and the vertical flanges 10 and the running flanges 9 of the pull-out rail 2 curvingly merge with one another in such a manner that they form a bent path or seat for the balls 14.

The runner rollers 13 are held in lateral carriages.

The slides 11 at the drawer rail 12 are L-shaped and have guide faces 16 for the respective running flange 9. This guarantees good lateral stability of the guide rail assembly with good guidance between the drawer rail 12 and the pull-out rail 2.

Stops, not shown in the drawings, are provided on the horizontal running flanges 9 of the pull-out rail 2 and limit the withdrawal movement of the guide rail assembly.

Figure 11:
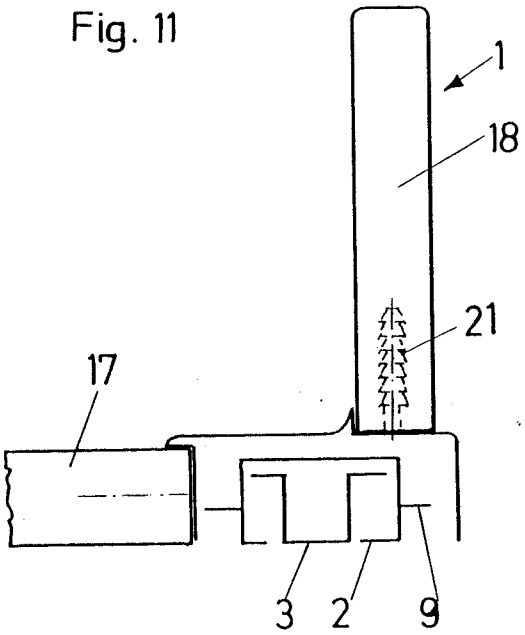
FIGS. 10 to 13 are diagrammatic views of different possibilities of arranging the guide rail assembly with respect to a drawer.
Figure 10:
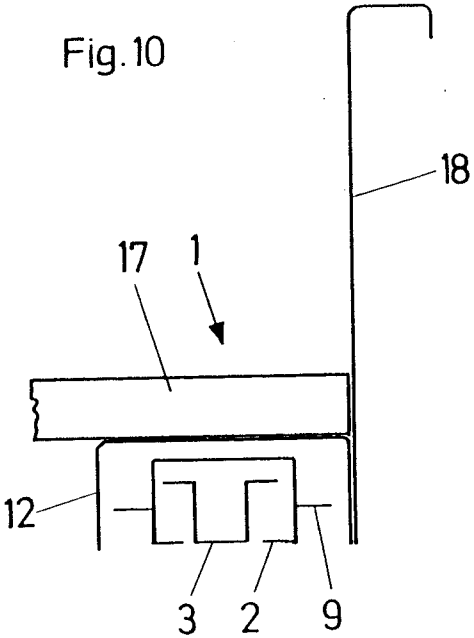
Figure 13:
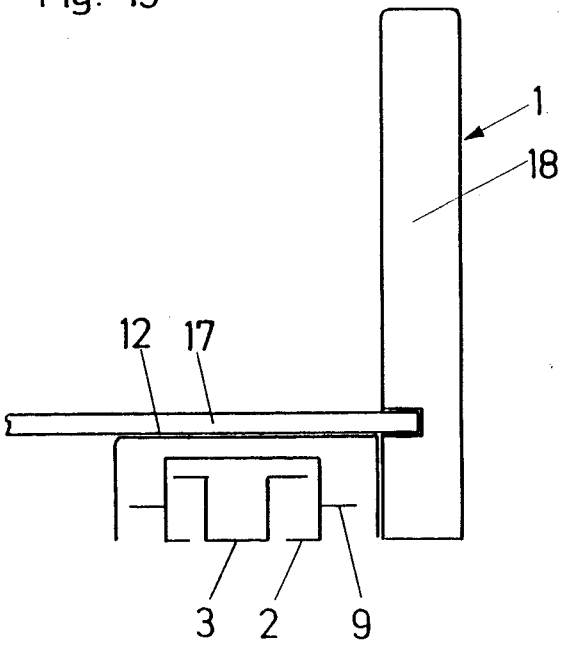
Figure 12:
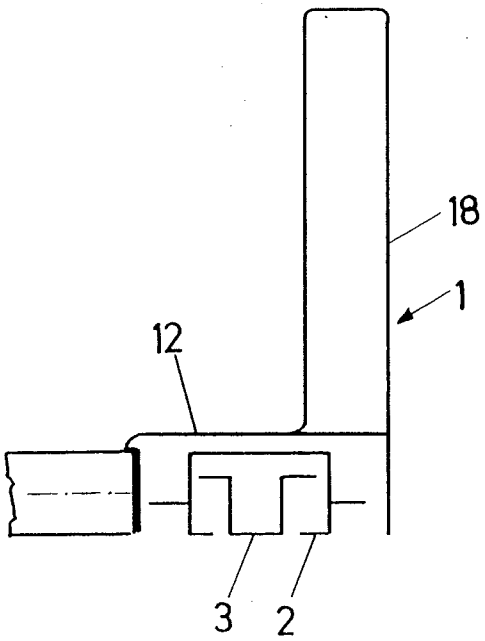

As can be seen from FIGS. 10 to 13, the pull-out guide assembly according to the invention is very flat and may either, as shown in FIGS. 10 and 13, be arranged underneath the drawer bottom 17 or, as shown in FIGS. 11 and 12, be arranged immediately beside the drawer bottom 17. In this arrangement, the drawer rail 12 may be direct continuation of the profile of the drawer side wall 18 (FIG. 12), or the drawer side wall 18 may be fastened to the drawer rail 12 as separate part, for example by a flange 21 with a fir-cone or serrated profile (FIG. 11).

To improve the lateral stability of the guide assembly, lateral compensating rollers 19 are mounted on the carriages 4 and 15.

I claim:

1. A guide rail assembly for use on each of opposite sides of a drawer for guiding movement of the drawer into and out of an article of furniture, said assembly comprising:

a supporting rail to be mounted on a side of the article of furniture, said supporting rail having a U-shaped guide flange defining a U-shaped channel and having outwardly projecting horizontal marginal flanges on each of opposite sides thereof;

a generally C-shaped pull-out rail embracing said guide flange of said supporting rail, said pull-out rail having on each of opposite sides thereof a generally vertical flange, a lower horizontal flange extending inwardly from a lower end of said vertical flange, and a horizontal running flange extending outwardly from said vertical flange at a position between said lower end thereof and an upper end thereof;

carriage means supporting a plurality rolling means substantially in a horizontal plane for enabling sliding movement between said pull-out rail and said supporting rail, said rolling means comprising central rolling means located in said U-shaped channel and rolling on said U-shaped guide flange and said pull-out rail and lateral rolling means, on each of opposite sides of said central rolling means, and rolling on a respective said lower horizontal flange of said pull-out rail and a respective said horizontal marginal running flange of said guide flange of said supporting rail; and a drawer rail to be mounted on a drawer and guided for sliding movement relative to said pull-out rail by means of guide means located at each of opposite sides of said drawer rail and slidably engaging both upper and lower surfaces a respective said horizontal running flange at a respective said side of said pull-out rail;

whereby the load of the drawer is transmitted from said drawer rail to said pull-out rail by said guide means and from said pull-out rail to said supporting rail by said rolling means.

2. An assembly as claimed in claim 1, wherein said drawer rail has a substantially inverted U-shape and embraces said pull-out rail.

3. An assembly as claimed in claim 1, wherein each said horizontal running flange of said pull-out rail has stop means to limit the extent of sliding movement of said pull-out rail relative to said supporting rail in a direction of extraction movement of the drawer.

4. An assembly as claimed in claim 1, wherein each said guide means comprises slide means mounted on said drawer rail and abutting one of said surfaces of said respective horizontal running flange of said pull-out rail, and further rolling means mounted in carriage means and rolling on the other of said surfaces of said respective horizontal running flange of said pull-out rail.

5. An assembly as claimed in claim 4, wherein said slide means abut said lower surface of said horizontal running flange.

6. An assembly as claimed in claim 5, wherein said slide means is generally L-shaped.

7. An assembly as claimed in claim 5, wherein said further rolling means rolls on said upper surface of said horizontal running flange and on said drawer rail.

8. An assembly as claimed in claim 7, wherein said further rolling means comprise runner rollers.

9. As assembly as claimed in claim 1, wherein each said guide means comprises ball members mounted in carriage means and rolling on both said upper and lower surfaces of said respective horizontal running flange of said pull-out rail.

10. An assembly as claimed in claim 1, wherein each said horizontal running flange extends outwardly from the respective said vertical flange at a position substantially midway between said lower and upper ends thereof.

11. An assembly as claimed in claim 1, wherein said rolling means comprise runner rollers.

* * * * *